US005423710A

United States Patent [19]

Tomberlin

[11] Patent Number: 5,423,710

[45] Date of Patent: Jun. 13, 1995

[54] COMBINED WALKING SPRING AMUSEMENT DEVICE AND ADAPTER THEREFOR

[76] Inventor: Rand K. Tomberlin, 4017 N. Bennington, Apt. 104, Kansas City, Mo. 64117

[21] Appl. No.: 291,105

[22] Filed: Aug. 16, 1994

[51] Int. Cl.[6] ..... A63H 33/00

[52] U.S. Cl. ..... 446/486; 446/431

[58] Field of Search ..... 446/431, 486, 490, 491; 267/168, 143, 166, 180; 248/166, 180

[56] References Cited

U.S. PATENT DOCUMENTS

| | | | |
|---|---|---|---|
| 1,108,310 | 8/1914 | Allen | 267/289 |
| 2,248,513 | 7/1941 | Riley | 248/311.2 |
| 2,415,012 | 1/1947 | James | 446/486 |
| 2,814,155 | 11/1957 | Greubel et al. | 446/486 |
| 4,749,112 | 6/1988 | Harper | 248/311.2 |
| 5,171,000 | 12/1992 | LaPointe | 267/166 |

OTHER PUBLICATIONS

"Slinky Eyes", *Playthings*, Mar. 1958, vol. 56, #3, p. 310.

*Primary Examiner*—Robert A. Hafer
*Assistant Examiner*—Jeffrey D. Carlson
*Attorney, Agent, or Firm*—Kokjer, Kircher, Bowman & Johnson

[57] ABSTRACT

A walking spring device having two or more distinct walking springs. Each of the springs is initially located in parallel side-by-side relation, and has a first and a second longitudinal end. The second end of a first of the springs is rigidly connected to the first end of the adjacent spring. In use, the first end of the first spring is deflected to cause the spring to undergo the known "walking" motion to a lower level, such as an adjacent stair step. When the second end of the first spring is drawn to the next level, the rigid connection causes the first end of the second spring to also be drawn to the next level. This in turn causes the second spring to undergo the known "walking" motion. The second spring will then continue this motion to the next level yet, and then cause the first spring to follow. This alternating process is repeated through the length of the stairs.

11 Claims, 1 Drawing Sheet

COMBINED WALKING SPRING AMUSEMENT DEVICE AND ADAPTER THEREFOR

BACKGROUND OF THE INVENTION

1. Field of the Invention

The present invention relates in general to amusement devices of the walking spring type. In particular, the present invention relates to an improved combined set of walking springs and an adaptor for forming same.

2. Description of the Related Art

For some years walking spring amusement devices, typically marketed under the mark SLINKY®, have been known. Such devices are well known and consist of a coil spring formed of a material having sufficient flexibility (in the longitudinal direction of the coil) and a low spring constant such that the spring would collapse upon itself to its solid height under the force of gravity. While such devices were initially formed of metal, in recent years plastics have been employed. The improved aesthetics (vibrant color combinations are commonly used) and safety has resulted in renewed interest in this device.

One of the more popular uses of such devices was causing the device to "walk" down a flight of stairs. As has been shown in extensive advertising, the device may be placed upright (i.e., the longitudinal axis vertical) adjacent the edge of an upper stair step. The user then grasps an upper portion of the device and pulls it over the edge of the stair step towards the next lower stair step. The relatively large number of coils, and low spring constant, of such devices permits this upper portion to contact the next lower stair step while the lower portion of the device is still in contact with the upper stair step.

The force of gravity and the elasticity of the device does, however, cause the coils to progressively move to the next lower stair until the entire device is located on the next lower stair in an inverted position. The momentum of the trailing end of the device will often cause this trailing (and now upper) end of the spring to continue beyond the main body of the device and fall to a yet lower stair step. From this point the coils are progressively drawn to this next lower stair step in a manner similar to that described above.

This process is repeated for the length of the stairs without intervention by the user. This unassisted motion of the device is quite popular, and its general motion gives an impression that the device is animated and "walking" down the stairs.

SUMMARY OF THE INVENTION

An object of the present invention is to provide an improved walking spring device which exhibits improved motion during "walking" upon stairs.

Another object of the present invention is to provide an adapter to modify existing spring devices to exhibit improved motion during "walking" upon stairs.

These and other objects are achieved by a walking spring device having two or more distinct walking springs. Each of the springs is initially located in parallel side-by-side relation, and has a first and a second longitudinal end. The second end of a first of the springs is rigidly connected to the first end of the adjacent spring. In use, the first end of the first spring is deflected to cause the spring to undergo the known "walking" motion to a lower level, such as an adjacent stair step. When the second end of the first spring is drawn to the next level, the rigid connection causes the first end of the second spring to also be drawn to the next level. This in turn causes the second spring to undergo the known "walking" motion. The second spring will then continue this motion to the next level yet, and then cause the first spring to follow. This alternating process is repeated through the length of the stairs.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
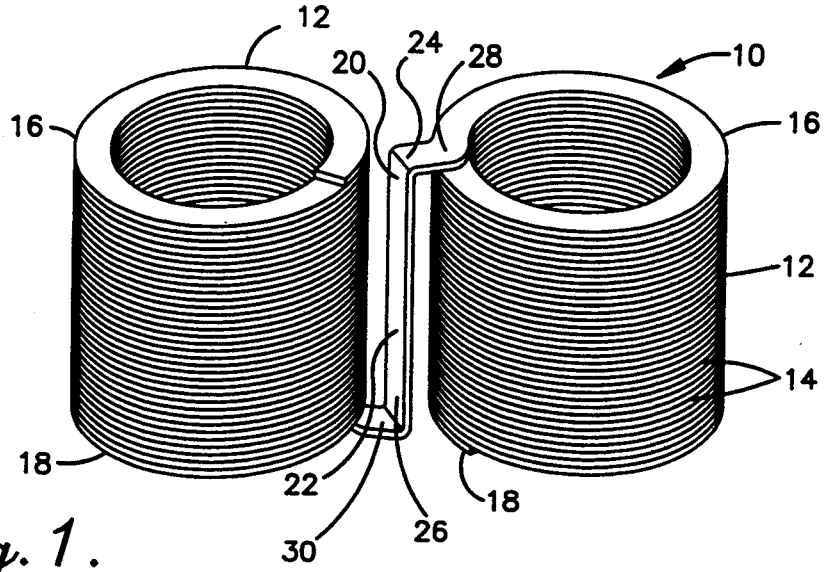
FIG. 1 is a perspective view of a first embodiment of the invention.

With reference to FIG. 1, reference numeral 10 generally designates a first embodiment of walking springs according to the present invention. The device 10 include two or more walking springs 12 similar to those in the prior art, such as those commonly sold under the trademark Slinky®.

In particular, each of the springs 12 consist of a plurality of helical or spiral coils 14 (only a few of which are shown for clarity) of a sufficiently elastic material to impart the known characteristics of a walking spring. Metals and plastics are known and acceptable materials, although others could be employed. As is known, the springs will have a low spring constant, such that the springs will, under the force of gravity, be compressed to their solid height.

Each of the springs will define a longitudinal axis about which the coils are formed. As such, in the rest position of FIG. 1, the longitudinal axes of the springs are essentially normal to the ground. Each of the springs will also have a first end 16 and a second end 18, in the longitudinal direction. These ends refer generally to the final full coil, and not to the free end of the coil.

In this first embodiment it can be seen that the device 10 include means 20 for connecting the second end of a first coil with a first end of a second coil (or, the first end of a first coil with the second end of a second coil). In this embodiment, this means 20 consists of a section of the same material used to form the coils, and in particular a section of this same monolithic material. The means generally consists of a span portion 22 having a length substantially corresponding to the solid height of the springs 12, and arranged generally parallel to the longitudinal axes of the springs.

The span portion 22 includes first and second ends 24 and 26, corresponding to the first and second ends of the springs. Connected to each of the ends of the span portion are connector segments 28 and 30. It is these connector segments which are directly connected to the springs. In this particular embodiment these connections are formed by the connector segments smoothly curving into the spiral form of the coils forming the springs.

The means 20 is sufficiently rigid that the motion of the connected ends of the springs are common (i.e., the ends move together as a unit, with their orientations remaining generally constant). Because of this the connecting means will be referred to as generally rigid. As used herein, generally rigid means that the means is sufficiently rigid to perform the noted function. Flexure between the ends, and changes in orientation during motion are acceptable, so long as the final orientations are sufficiently similar to cause the desired motion as discussed below. As may be envisioned, the material forming the connecting means 20 has similar strength and elastic properties of the remainder of the springs. Such an arrangement is believed to be generally rigid as defined herein.

In use, the device will provide a motion similar to that known in prior-art walking springs upon successive ground levels, such as a set of stairs. In particular, from the position shown in FIG. 1, the first end 16 of the first spring is deflected to cause the spring to undergo the known "walking" motion to the next lower level, such as an adjacent stair step. When the second end 18 of the first spring is drawn to the next level, the generally rigid connecting means 20 causes the first end 16 of the second spring to also be drawn to the next level. This in turn causes the second spring to undergo the known "walking" motion. At this point the device will be upside-down compared to the orientation of FIG. 1. In a known manner, the second spring will then continue this motion to the next level yet, and then cause the first spring to follow in a manner similar to that described above. This alternating process is repeated through the length of the stairs.

Figure 2:
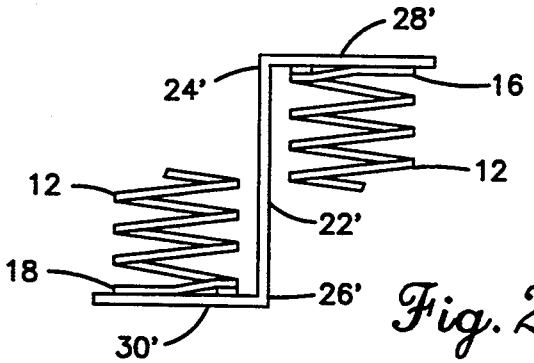
FIG. 2 is a side view of a second embodiment.
Figure 3:
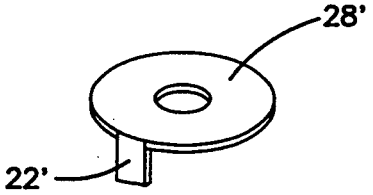
FIG. 3 is a perspective detail view of the second embodiment.

With reference to FIGS. 2 and 3, a second embodiment of the device is shown. In this embodiment, the device 10 is formed of two discrete springs 12, and the connecting means 20 is formed as a separate device which is attached to the springs.

In particular, the means 20 includes a span portion 22' having first and second ends 24' and 26'. Also as before, the means includes connector segments 28' and 30'. In this embodiment, however, the connector segments are formed as planar supports. At least a portion of the final full coil at each of the associated ends of the springs are secured to the inwardly facing faces of the connector segments, as shown in FIG. 2. This connection may be by adhesive or thermal bonding, fasteners, etc.

Figure 4:
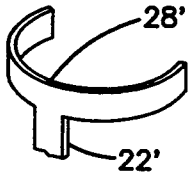
FIGS. 4 and 5 are perspective views of a third and fourth embodiments, respectively.

A third embodiment is shown in FIG. 4. In this embodiment the span 22' is unchanged, but the connector segments 28' (only one being shown) are formed as a section of a cylinder. This cylindrical section will have an interior diameter corresponding to the outer diameter of the springs, such that the inner face may be secured to the outer edge of one or more coils adjacent the associated ends of the springs. As before, the securement may be by adhesive or thermal bonding, or by fasteners. In this embodiment it is noted that more than one coil my be secured, and that the secured coil(s) need not be the endmost. If the segment is secured to coils spaced from the endmost coils, however, this simply reduces the amount of coils available for motion, and is not particularly preferred.

Figure 5:
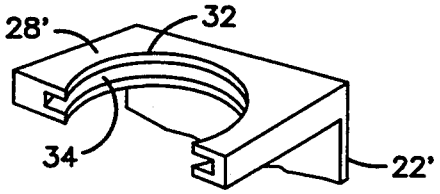

A fourth embodiment is shown in FIG. 5. As before, the span 22' is similar to other embodiments, although is wider. The particular width employed on this or other embodiments is of course not critical so long as the desired generally rigid arrangement is produced.

In this fourth embodiment the connector segments (only one being shown) take the form of a planar support, with a central opening 32 having a diameter less than the outer diameter of the springs 12. The opening overlaps an outer edge of the support, such that the opening has a radial extend of less than 360°, but more than 180°. Centrally located within the thickness of each segment is a groove 34 which is coaxial with the opening. The groove has a diameter slightly greater than the outer diameter of the springs 12. As such, one or more coils can be inserted within the groove by manual pressing, with the angular extent of the groove serving to maintain the coil(s) in position. As with the last embodiment, the coil(s) employed need not be the final coils, although this may be preferred.

Figure 6:
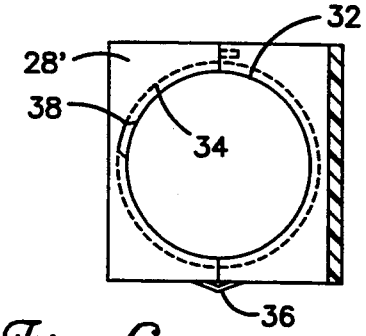
FIG. 6 is a top cross-sectional view of the fifth embodiment.

A fifth embodiment of the invention is shown in FIG. 6. This embodiment is similar to the previous embodiment in that the connector segments (only one being shown) are generally planar supports having an opening 32 and a groove 34. In this embodiment, however, the opening and groove form a full circle, with the connector segment being formed in two sections joined by a hinge 36, preferably a living hinge. There may also be an appropriate latch such as a pin forming an interference fit within a mating hole.

It is noted that the support also includes a cut-out section 38 from the interior of the opening to the outer edge of the groove. This will permit the coils of the spring pass through the segment 28'. A further cut-out may be provided on the outer face of the segment(s) to permit use of coils which are not the final coils, as discussed above. This cut-out section may also be used to thread the endmost coil(s) into the groove from the free end of the spring. If this technique is used the segment need not be hinged.

Figure 7:
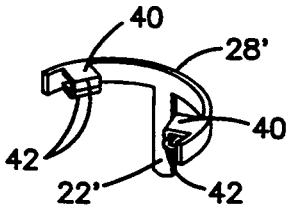
FIG. 7 is a perspective view of a sixth embodiment.

A sixth and final embodiment is shown in FIG. 7. This embodiment is similar to the embodiment of FIG. 4 in that the connector segments (only one being shown) take the form of cylindrical sections sized to partially surround the coil. In this embodiment, however, one or more sets of gripping arms 40 protrude radially inward from the connector segments. The gripping arms are parallel cantilevered arms having opposed flanges 42 at their outer free ends. The space defined by the cylindrical section, arms and flanges is sized to closely receive one or more coils of the associated spring. The coil(s) will simply be manually pressed into this space to retain the coils(s). Alternatively, the arms could be connected at their outer ends, and the coils could be threaded into the spaces, starting with the free end of the spring.

As may be envisioned, the embodiments of FIGS. 2 onward may be employed with existing springs, and require only the purchase of the connecting means. Further, the embodiments of FIGS. 5 onward allow the springs to be removed when normal operation as in the prior art is desired, and then reattachment.

It is also noted that while two springs have been shown connected with a single connector means, additional springs and connectors, such as three or four springs with an appropriate number (number of springs minus 1) may be used. The additional springs will be connected in serial fashion such that all spring will pass to the next level or stair step before moving on to a further level.

Figure 8:
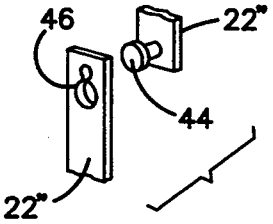
FIG. 8 is a perspective view of a connecting arrangement according to the present invention.

Although it is not relevant to actual use of the device, formation of the connecting means as a monolithic unit may be 10 difficult, especially for injection molding techniques. As such, it may be desirable to form a span 22" as two beams, each having a connector segment at an outer end. The inner ends of the beams may then be connected together to complete the assembly of the connecting means. This connection may be effected by various means. As shown in FIG. 8, one example is a post 44 having an enlarged head which is received within a keyhole opening 46. Other possibilities are adhesive or thermal bonding, fasteners such as bolts, or other interference fit connections.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A walking spring amusement device, comprising:

at least two walking springs, each having a plurality of coils along a longitudinal axis and a low spring constant such that said springs collapse under the force of gravity to their solid height, and first and second ends, said springs being arranged in parallel side-by-side relation and oriented with said first ends adjacent; and means for connecting a first one of said springs, at least in proximity to said first end, to a second one of said springs, at least in proximity to said second end, in a generally rigid manner.

2. A walking spring amusement device, comprising:

at least two walking springs, each having a plurality of coils along a longitudinal axis and a low spring constant such that said springs collapse under the force of gravity to their solid height, and first and second ends, said springs being arranged in parallel side-by-side relation with said first ends adjacent;

a span located between each adjacent pair of said springs, each said span being elongated and extending generally parallel to said longitudinal axis, and having first and second ends in proximity to said first and second ends of said adjacent springs; and a connector segment located on each of said ends of each said span, a first of said connector segments being secured to a first one of said adjacent springs at least in proximity to its end nearest said first connector segment, and a second of said connector segments being secured to a second one of said adjacent springs at least in proximity to its end nearest said second connector segment.

3. A device as in claim 2, wherein said springs, span and connector segments are a monolithic unit.

4. A device as in claim 2, wherein each of said connector segments includes a generally planar support extending normal to said axis.

5. A device as in claim 4, wherein each of said connector segments is permanently secured to a portion of an endmost coil of an associated one of said springs.

6. A device as in claim 4, wherein said connector segments are releasably secured to said springs.

7. A device as in claim 6, wherein each said connector segment includes a central opening therethrough, said opening having a peripheral extent of less than 360° but more than 180°, and further including a groove extending inwardly from, and coaxial with, said opening, said opening having a diameter less than, and said groove having a diameter greater than, an outer diameter of an associated one of said springs.

8. A device as in claim 6, wherein each said connector segment includes a central opening therethrough, and further including a groove extending inwardly from, and coaxial with, said opening, said opening having a diameter less than, and said groove having a diameter greater than, an outer diameter of an associated one of said springs, and further including a cut-out segment extending from said opening to said groove.

9. A device as in claim 2, wherein said connector segments take the form of a section of a cylinder having an outer diameter and orientation substantially equal to that of said springs.

10. A device as in claim 9, wherein each said connector segment is permanently attached to an associated one of said springs.

11. A device as in claim 9, wherein each said connector segment includes at least one pair of gripping arms extending radially inward in spaced relation, and opposing flanges being mounted on ends of said arms, whereby one or more coils may be secured between said arms.

* * * * *